US009153174B2

(12) United States Patent
Tang

(10) Patent No.: US 9,153,174 B2
(45) Date of Patent: Oct. 6, 2015

(54) METHOD FOR DRIVING ACTIVE DISPLAY

(75) Inventor: Yu-Chun Tang, Kaohsiung Hsien (TW)

(73) Assignee: AU OPTRONICS CORP., Hsinchu (TW)

( * ) Notice: Subject to any disclaimer, the term of this patent is extended or adjusted under 35 U.S.C. 154(b) by 2079 days.

(21) Appl. No.: 11/417,136

(22) Filed: May 4, 2006

(65) Prior Publication Data

US 2006/0267050 A1 Nov. 30, 2006

(30) Foreign Application Priority Data

May 24, 2005 (TW) ..... 94116932 A

(51) Int. Cl.
*G09G 3/36* (2006.01)
*G09G 3/32* (2006.01)

(52) U.S. Cl.
CPC ..... *G09G 3/325* (2013.01); *G09G 2300/0417* (2013.01); *G09G 2300/0842* (2013.01); *G09G 2310/0251* (2013.01); *G09G 2310/0254* (2013.01); *G09G 2320/043* (2013.01)

(58) Field of Classification Search
USPC ..... 345/94, 98–99, 55
See application file for complete search history.

(56) References Cited

U.S. PATENT DOCUMENTS

| | | | | |
|---|---|---|---|---|
| 5,485,423 | A * | 1/1996 | Tang et al. | 365/185.19 |
| 6,017,792 | A * | 1/2000 | Sharma et al. | 438/257 |
| 6,040,814 | A * | 3/2000 | Murakami et al. | 345/94 |
| 6,600,350 | B2 | 7/2003 | Sekimoto et al. | |
| 6,611,248 | B2 * | 8/2003 | Kanbara et al. | 345/100 |
| 6,680,580 | B1 | 1/2004 | Sung | |
| 6,970,026 | B2 | 11/2005 | Kang | |
| 7,019,725 | B1 * | 3/2006 | Lee et al. | 345/98 |
| 7,355,581 | B2 | 4/2008 | Kim | |
| 7,557,780 | B2 * | 7/2009 | Kimura | 345/76 |
| 2002/0145913 | A1 * | 10/2002 | Tanaka et al. | 365/185.22 |
| 2002/0171462 | A1 | 11/2002 | Sekimoto et al. | |
| 2003/0112205 | A1 | 6/2003 | Yamada | |
| 2003/0210212 | A1 | 11/2003 | Li et al. | |

(Continued)

FOREIGN PATENT DOCUMENTS

| | | | |
|---|---|---|---|
| CN | 1492665 | A | 4/2004 |
| KR | 10-2004-0067412 | A | 7/2004 |

(Continued)

OTHER PUBLICATIONS

Abstract only for KR-2005-0004431, Published Jan. 12, 2005.

*Primary Examiner* — William Boddie
*Assistant Examiner* — Leonid Shapiro
(74) *Attorney, Agent, or Firm* — WPAT, PC; Justin King

(57) ABSTRACT

A method for adjusting the electricity of a TFT has the steps of starting a displaying sequence by driving the TFT and resetting the electricity of the TFT. The step of starting the display sequence by driving the TFT further comprises the steps of: (a) providing a gate driving voltage to the gate electrode of the TFT; (b) providing a source driving voltage to the source electrode of the TFT; and (c) providing a drain driving voltage to the drain electrode of the TFT. The step of resetting the electricity of the TFT comprises the steps of: (a) providing a gate resetting voltage to the gate electrode of the TFT; (b) providing a source resetting voltage to the source electrode of the TFT; and (c) providing a drain resetting voltage to the drain electrode of the TFT. The gate resetting voltage is smaller than or equal to the source resetting voltage or the drain resetting voltage. The source resetting voltage and the drain resetting voltage are adjustable.

16 Claims, 6 Drawing Sheets

(56) References Cited

U.S. PATENT DOCUMENTS

| | | | |
|---|---|---|---|
| 2004/0017336 | A1 | 1/2004 | Chang |
| 2004/0189358 | A1 | 9/2004 | Kang |
| 2005/0001799 | A1 | 1/2005 | Kim |

FOREIGN PATENT DOCUMENTS

| | | | |
|---|---|---|---|
| TW | 557628 | B | 10/2003 |
| TW | 587366 | B | 5/2004 |

* cited by examiner

METHOD FOR DRIVING ACTIVE DISPLAY

This application claims the benefit of Taiwan Application Serial No. 094116932, filed May 24, 2005, the subject matter of which is incorporated herein by reference.

BACKGROUND OF THE INVENTION (1) Field of the Invention

The present invention relates to a method for driving an active display, and more particularly relates to a driving method with a reset process.

(2) Description of the Prior Art

An organic light emitted diode (OLED) is an illumination device activated by electric current. The illumination of the OLED is changed with the applied current. Active elements for activating the BLED in present can be classified into low temperature polysilicon thin film transistor (LTPS-TFT) and amorphous silicon thin film transistor (a-Si TFT). The LTPS-TFT is widely used nowadays. Whereas the a-Si TFT with the advantages of fewer lithographic steps and lower temperature in the fabrication process is preferred to be the trend in the future. However, both the LTPS-TFT and the a-SI TFT has a problem that the current passing through the OLED is decreased due to the increasing of threshold voltage. The problem is more significant for the OLED using a-Si TFT as active elements.

As an amorphous-TFT based OLED panel is operated, a high electric current passes through the channel of the a-Si TFT. Therefore, the electrons are easily trapped in the gate dielectric to raise the threshold voltage of the a-Si TFT and decrease. As a result, the electric current is decreased to reduce the illumination of the OLED and badly influence the life of the OLED panel.

In present, for solving the above mentioned problem, a typical method is to apply an electric field from the source/drain electrode of the TFT toward the gate electrode for driving the electrons away from the gate dielectric to recover the original threshold voltage. There two embodiments for the method:

First, as shown in FIG. 1A, the source/drain electrode of each pixel is applied with a positive resetting voltage Vs' or Vd' respectively. Thereby, the electric field from the source/drain electrode pointing to the gate electrode is formed to release the electrons trapped in the gate dielectric back to the channel of the TFT.

Second, as shown in FIG. 1B, the gate electrode of each pixel is applied with a negative resetting voltage Vg'. Thereby, the electric field from the source/drain electrode pointing to the gate electrode is formed to release the electrons trapped in the gate dielectric back to the channel of the TFT.

Also referring to FIG. 1C, as the electric field is formed to release the electrons 13. The electrons 13 trapped in the gate dielectric 11 of the TFT 10 have the motion opposite to the direction of the electric field back to the channel 14 so as to recover the amount of free electrons within the channel 14 to prevent the increasing of the threshold voltage.

In the related art, as the gate driving voltage Vg is remained, the source/drain electrode should be applied with a greater positive voltage to increase the drain/source voltage Vd, Vs to the resetting voltage Vs', Vd'. As the drain voltage Vd and the source voltage Vs are remained, the gate electrode should be applied with a greater negative voltage to decrease the gate driving voltage Vg to the gate resetting voltage Vg'.

The greater positive voltage or negative voltage applied to the gate dielectric may reduce the operation efficiency of the OLED.

SUMMARY OF THE INVENTION

It is a main object of the present invention to provide a method for lowering the resetting voltage applied to the source/drain electrode or increasing the resetting voltage applied to the gate electrode to adjust the electricity of the TFT of the ELD panel efficiently.

The method provided in the present invention focuses on adjusting the electricity of a TFT. The method has the steps of starting a displaying sequence by driving the TFT and resetting the electricity of the TFT. The step of starting the display sequence by driving the TFT further comprises the steps of: (a) providing a gate driving voltage to the gate electrode of the TFT; (b) providing a source driving voltage to the source electrode of the TFT; and (c) providing a drain driving voltage to the drain electrode of the TFT. The step of resetting the electricity of the TFT comprises the steps of: (a) providing a gate resetting voltage to the gate electrode of the TFT; (b) providing a source resetting voltage to the source electrode of the TFT; and (c) providing a drain resetting voltage to the drain electrode of the TFT. The gate resetting voltage is smaller than or equal to at least one of the source resetting voltage and/or the drain resetting voltage. The source resetting voltage and the drain resetting voltage are adjustable, so that a potential difference between the gate voltage and one of the source voltage and the drain voltage is variable. That is to say, the source resetting voltage and the drain resetting voltage can be controlled to more than three voltage levels, for example, positive, negative or 0.

The step of resetting the electricity of the TFT is hardware operated by using a driving chip to control the operating sequence. In order to decrease the absolute voltage level to reduce the power consumption, the present invention applies resetting voltages to the gate electrode, drain electrode, and the source electrode. The source electrode and the drain electrode are applied with positive resetting voltage, and the gate electrode is applied with negative resetting voltage. Thereby, a potential difference large enough to release the electrons within the gate dielectric is generated without the need of a large absolute voltage so as to increase the power efficiency of the panel.

By experiment, there needs a potential difference of about 30 volt between the gate resetting voltage and the source/drain resetting voltage. In the related art, the potential of the gate electrode and the source/drain electrode are not simultaneously changed to reset the TFT. In contrast, there needs only a potential between −15 and +15 volt being applied to the gate electrode and the source electrode respectively to generate a potential difference of about 30 volt for the object of resetting the TFT.

BRIEF DESCRIPTION OF THE DRAWINGS

The present invention will now be specified with reference to its preferred embodiment illustrated in the drawings, in which.

DESCRIPTION OF THE PREFERRED EMBODIMENTS

FIG. 2 shows an electric circuit diagram of a pixel of an active electro luminescent display (ELD). The pixel has a scan line Scan, a data line Data, a switching transistor Ta, a driving transistor Tb, an luminescent element E, and a capacitor C. The source electrode and the gate electrode of the switching transistor Ta are electrically connected to the data line Data and the scan line Scan, respectively. The drain electrode D and source electrode S of the driving transistor Tb are electrically connected to the luminescent element E and a secondary voltage source, respectively. The gate electrode G of the driving transistor Tb is electrically connected to the drain electrode of the switching transistor Ta, the capacitor C, and a resetting voltage source Vreset. The luminescent element E has an electrode electrically connected to the drain electrode D of the driving transistor Tb and another electrode electrically connected to a displaying voltage source.

Figure 1A:
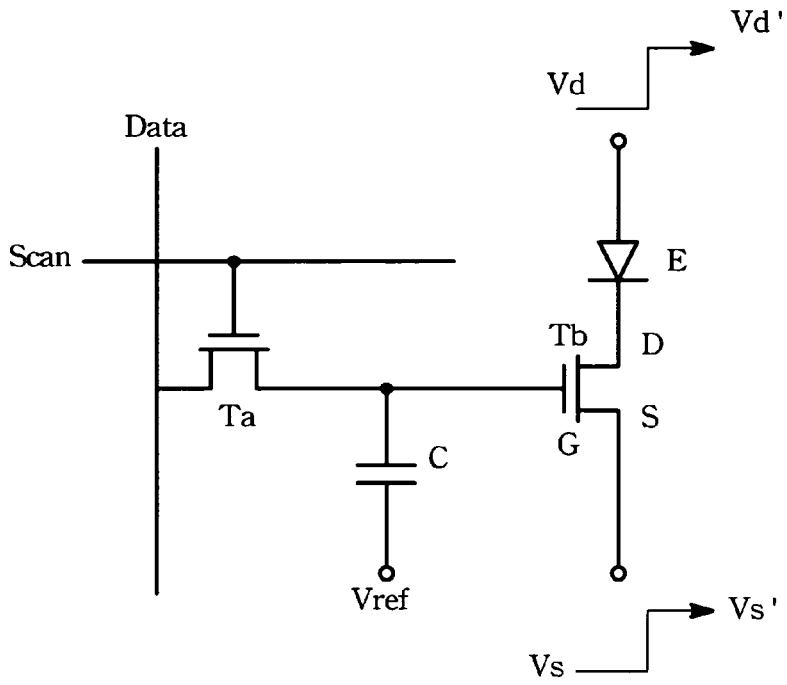
FIG. 1A (Related Art)
FIG. 1A is a electric circuit diagram of a typical pixel.
Figure 1B:
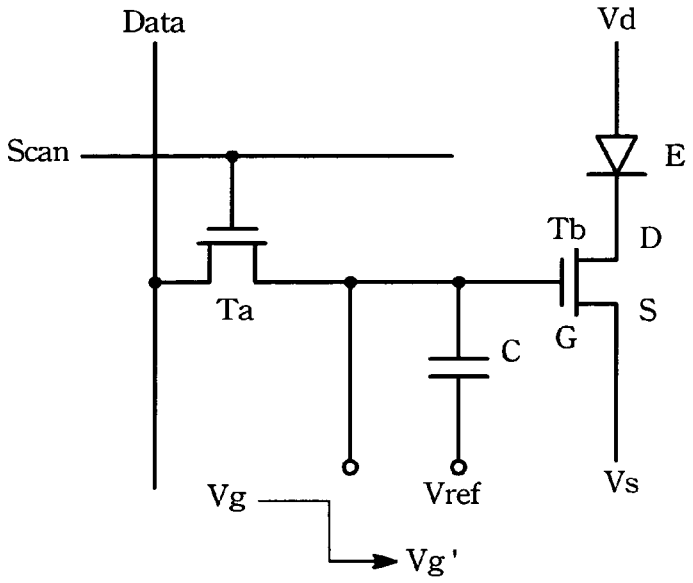
FIG. 1B (Related Art)
FIG. 1B is a electric circuit diagram of another typical pixel.
Figure 1C:
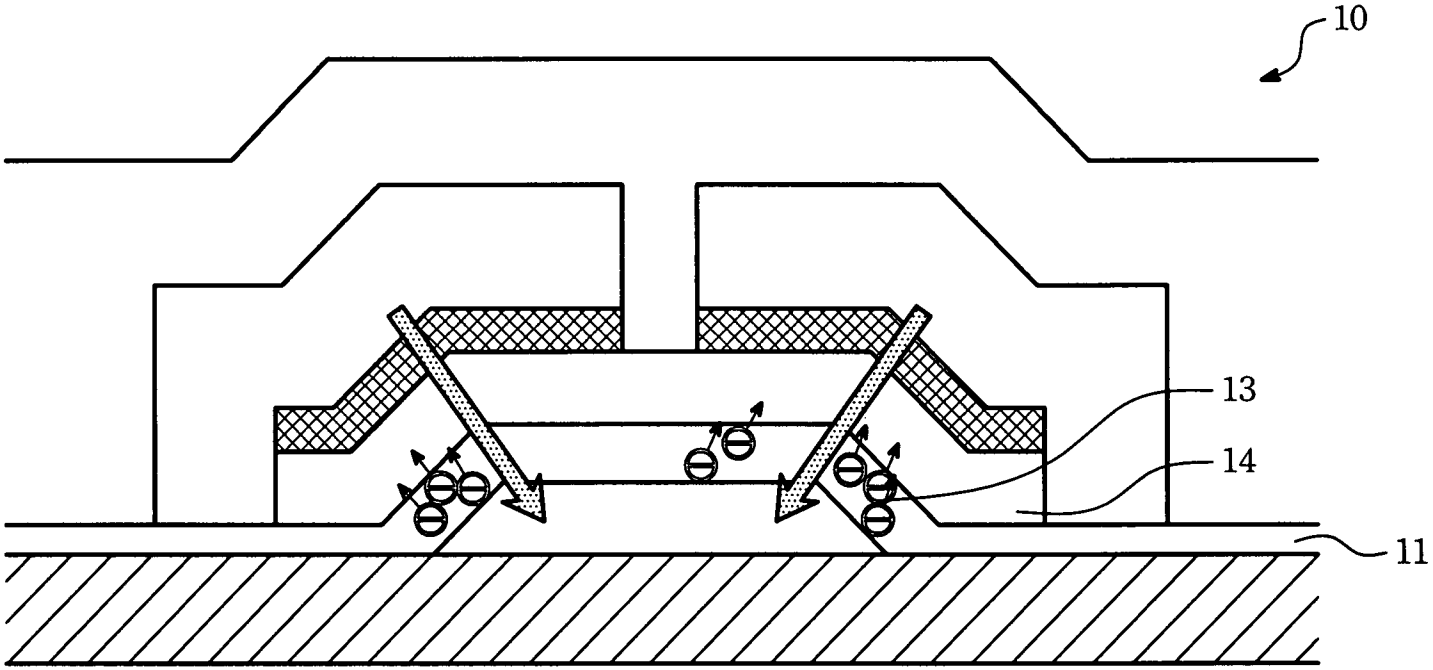
FIG. 1C (Related Art)
FIG. 1C describes the motion of the electrons within the gate dielectric of the TFT as the pixels of FIGS. 1A and 1B are operated.
Figure 2A:
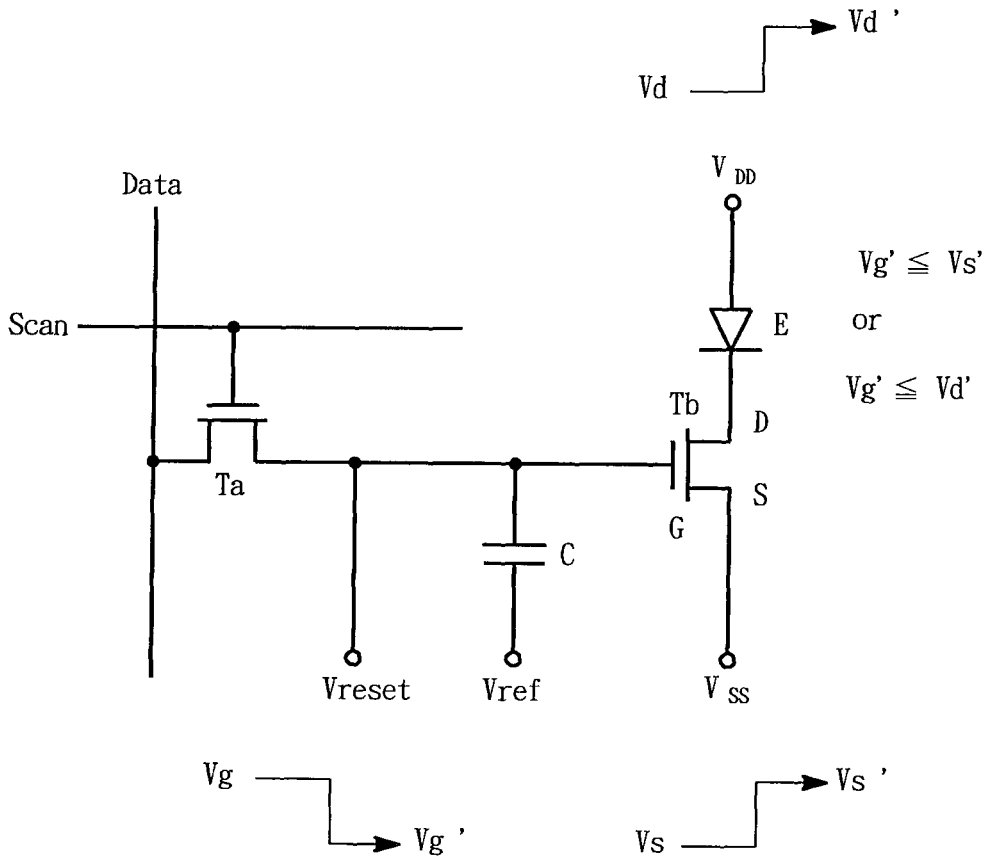
FIG. 2A is a electric circuit diagram of a pixel of an active ELD in accordance with the present invention.

The method with respect to the electric circuit as shown in FIG. 2A to reset the electricity of the driving transistor Tb comprises the steps of: providing a gate voltage to the gate electrode G of the driving transistor Tb; providing a source voltage to the source electrode S of the driving transistor Tb; and providing a drain voltage to the drain electrode D of the driving transistor Tb. All the gate voltage, the source voltage and the drain voltage are adjustable. For instance, the gate voltage is lowered from an original voltage Vg to a resetting voltage Vg', the source voltage is increased from an original voltage Vs to a resetting voltage Vs', and the drain voltage is increased from the original voltage Vd to a resetting voltage Vd'. The resetting gate voltage Vg' is smaller than or equal to at least one of the resetting source voltage Vs' and the resetting drain voltage Vd' to form an electric field between the gate electrode G and the source electrode S or the drain electrode D to release the electrons trapped in the gate dielectric layer back to the channel of the driving transistor Tb.

Figure 2B:
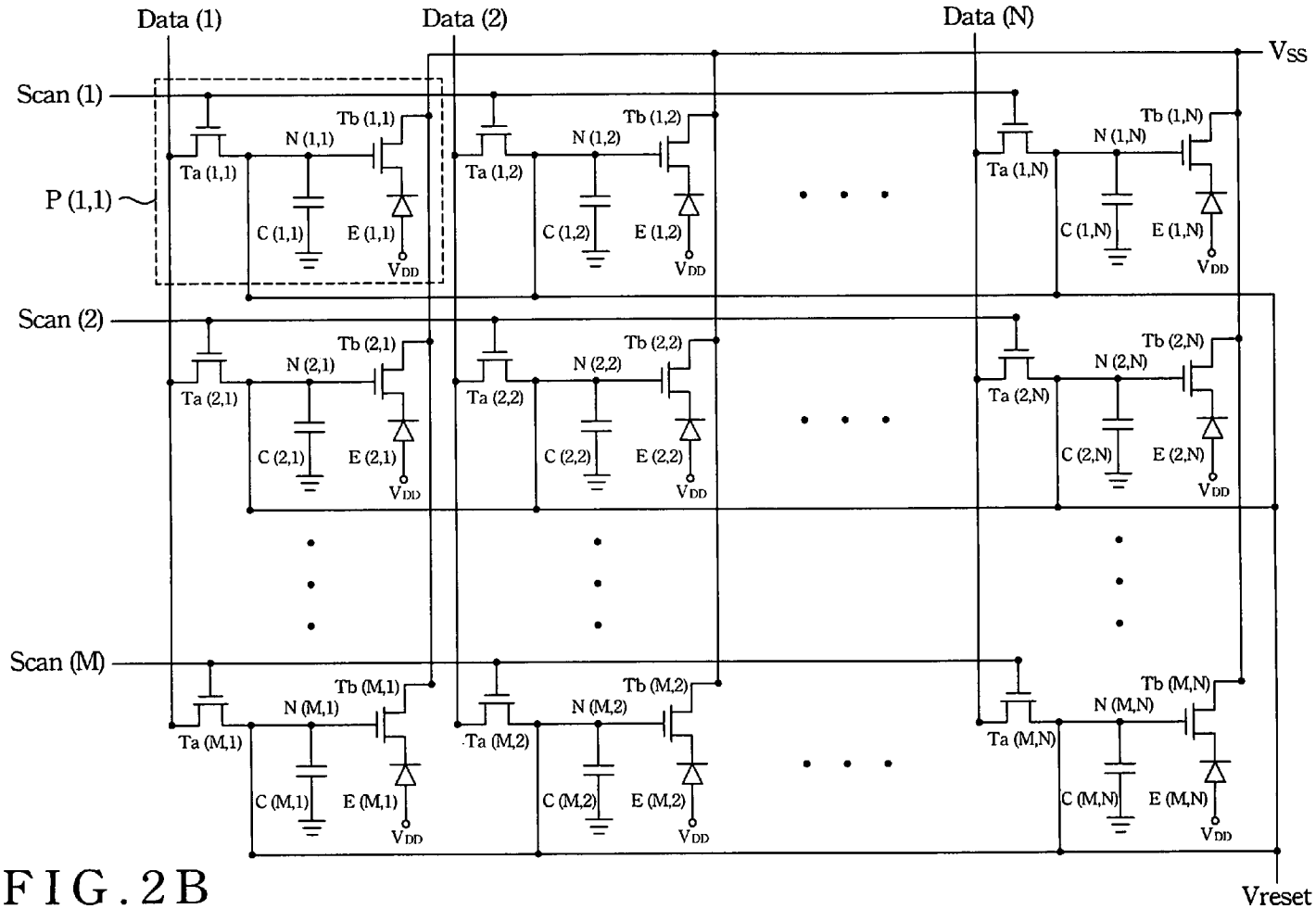
FIG. 2B shows a pixel array of the active ELD in accordance with the present invention.

Also referring to FIG. 2B, the active display has a pixel array composed of M×N pixels to show a frame within a display sequence. Take the pixel P(1,1) for example, the source electrode and the gate electrode of the switching transistor Ta(1,1) are electrically connected to the data line Data (1) and the scan line Scan(1), and the drain electrode thereof is electrically connected to the capacitor C(1,1) and the gate electrode of the driving transistor Tb(1,1). The drain electrode D of the driving transistor Tb(1,1) is electrically connected to the cathode of the luminescent element E and receives a drain driving voltage Vd from the displaying voltage source $V_{DD}$ through the anode of the luminescent element E. The source electrode S of the driving transistor Tb(1,1) is electrically connected to the secondary voltage source to receive a source driving voltage. The gate electrode G of the driving transistor Tb(1,1) is electrically connected to an additional resetting voltage source Vreset to receive a resetting voltage for resetting electricity of the driving transistor Tb(1,1). Not earlier than receiving the resetting voltage, a drain resetting voltage Vd' is provided by the displaying voltage source $V_{DD}$ or a source resetting voltage Vs' is provided by the secondary voltage source $V_{SS}$. In addition, both the drain resetting voltage Vd' and the source resetting voltage Vs' may be provided to the driving transistor Tb(1,1) as a preferred embodiment.

The preferred embodiment of the above mentioned method may be: (a) simultaneously performing the step of providing the gate voltage to the gate electrode G of the driving transistor Tb and the step of providing the source voltage to the source electrode S of the driving transistor; (b) simultaneously performing the step of providing the gate voltage to the gate electrode G of the driving transistor Tb and the step of providing the drain voltage to the drain electrode D of the driving transistor Tb; (c) simultaneously performing the step of providing the gate resetting voltage Vg' to the gate electrode G of the driving transistor Tb, the step of providing the drain resetting voltage Vd' to the drain electrode D of the driving transistor Tb, and the step of providing the source resetting voltage Vs' to the source electrode of the driving transistor Tb.

As a preferred embodiment, the above mentioned voltages are ranged as followed: the gate voltage should be smaller than or equal to about 0 volt, and about −10 volt is preferred; the source voltage should be greater than or equal to about 10 volt, and about 15 volt is preferred; the drain voltage should be greater than or equal to about 10 volt, and about 15 volt is preferred. In addition, a potential difference between the gate voltage and the source voltage should be ranged from about 10 to about 100 volt, and about 30 to about 100 volt is preferred. A potential difference between the gate voltage and the drain voltage should be ranged from about 10 to about 100 volt, and about 30 to about 100 volt is preferred.

The above mentioned method is adapted to N-type a-Si TFT. In addition, the method of connecting the cathode of the luminescent element E to the drain electrode of the driving transistor Tb is usually adopted by inverted OLED.

When the OLED displays, the gate driving voltage Vg is applied to the driving transistor Tb from the data line Data through the switching transistor Ta. When resetting electricity of the driving transistor Tb, the gate voltage is decreased from the gate driving voltage Vg to the gate resetting voltage Vg', the source voltage and the drain voltage is increased from the source driving voltage Vs and the drain driving voltage Vd to the source resetting voltage Vs' and the drain resetting voltage Vd', respectively. It is noted that the gate resetting voltage Vg' may be smaller than the source resetting voltage Vs' and the drain resetting voltage Vd'. Since the turn on voltage of the N-type TFT is positive, the gate resetting voltage Vg' is usually smaller than the turn on voltage of the driving transistor Tb. In practice, the potential difference between the gate resetting voltage Vg' and the source resetting voltage Vs' or the drain resetting voltage Vd' is usually greater than or equal to about 10 volt.

For example, when the panel displays, the gate driving voltage Vg of the driving transistor Tb is influenced by the signals provided from the data line, the drain driving voltage Vd, and the source driving voltage Vs. Whereas, the drain driving voltage Vd maintains a steady voltage level of +12 volt and the source driving voltage Vs maintains a steady voltage level of 0 volt. When resetting, the drain voltage and the source voltage is increased to 30 volt, and the gate voltage is decreased by 15 volt from the gate driving voltage Vg. It is noted that there is no current passing through the source/drain electrode of the driving transistor.

The present invention may be used for resetting electricity of various types of N-channel TFT. The N-channel TFT is classified into depletion mode and enhancement mode. The amorphous layer of the depletion mode N-channel TFT is usually N-type doped. The amorphous layer of the depletion mode N-channel TFT may be P-type doped or undoped. In the present fabrication process, besides the source/drain electrodes, the amorphous layer on the glass substrate is undoped.

When starting an ELD with the provided method to adjust the electricity of the driving transistor Tb, the driving transistor is driven and the electricity thereof is reset. The process to drive the driving transistor Tb has the steps of: providing the gate driving voltage Vg to the gate electrode of the driving transistor Tb; providing the source driving voltage Vs to the source electrode of the driving transistor Tb; providing the drain driving voltage Vd to the drain electrode of the driving transistor Tb. The process to reset the driving transistor has the steps of: providing the gate resetting voltage Vg' to the gate electrode of the driving transistor Tb; providing the source resetting voltage Vs' to the source electrode of the driving transistor Tb; and providing the drain resetting voltage Vd' to the drain electrode of the driving transistor Tb. The gate resetting voltage Vg' should be smaller than or equal to at least one of the source resetting voltage Vs' and the drain resetting voltage Vd'. In addition, the source resetting voltage Vs' or the drain resetting voltage Vd' should be adjustable, so that a potential difference between the gate voltage Vg and one of the source voltage Vs and the drain voltage Vd is variable. That is to say, the source resetting voltage Vs' and the drain resetting voltage Vd' can be controlled to more than three voltage levels, for example, positive, negative or 0.

For example, the gate driving voltage Vg should be ranged from about 0 to about 10 volt, the drain driving voltage Vd should be ranged from about 10 to about 20 volt, and the source driving voltage Vs should be about 0 volt. In addition, the potential difference between the gate resetting voltage Vg' and the source resetting voltage Vs' should be ranged from about 10 to about 100 volt, and about 30 to about 100 volt is preferred. The potential difference between the gate resetting voltage Vg' and the drain resetting voltage Vd' should be ranged from about 10 to about 100 volt, and about 30 to about 100 volt is preferred. The gate resetting voltage Vg' should be smaller than or equal to about 0 volt, and about −10 volt is preferred. When resetting the electricity of the N-type transistor, the gate resetting voltage Vg' should be smaller than or equal to the gate driving voltage Vg, the source resetting voltage Vs' should be greater than or equal to the source driving voltage Vs, and the drain resetting voltage Vd' should be greater than or equal to the drain driving voltage Vd.

It is noted that the transistors Ta and Tb of the above mentioned embodiment are N-type transistors. The provided resetting electric field should be from the source/drain electrode pointing to the gate electrode to release the electrons trapped in the gate dielectric. As the P-type transistors are used, since there are holes trapped in the gate dielectric, the resetting electric field should be from the gate electrode pointing to the source/drain electrode. That is, a positive gate resetting voltage Vg', a negative source resetting voltage Vs', and a negative drain resetting voltage Vd' should be provided for resetting the P-type transistor in accordance with the present invention.

Figure 3:
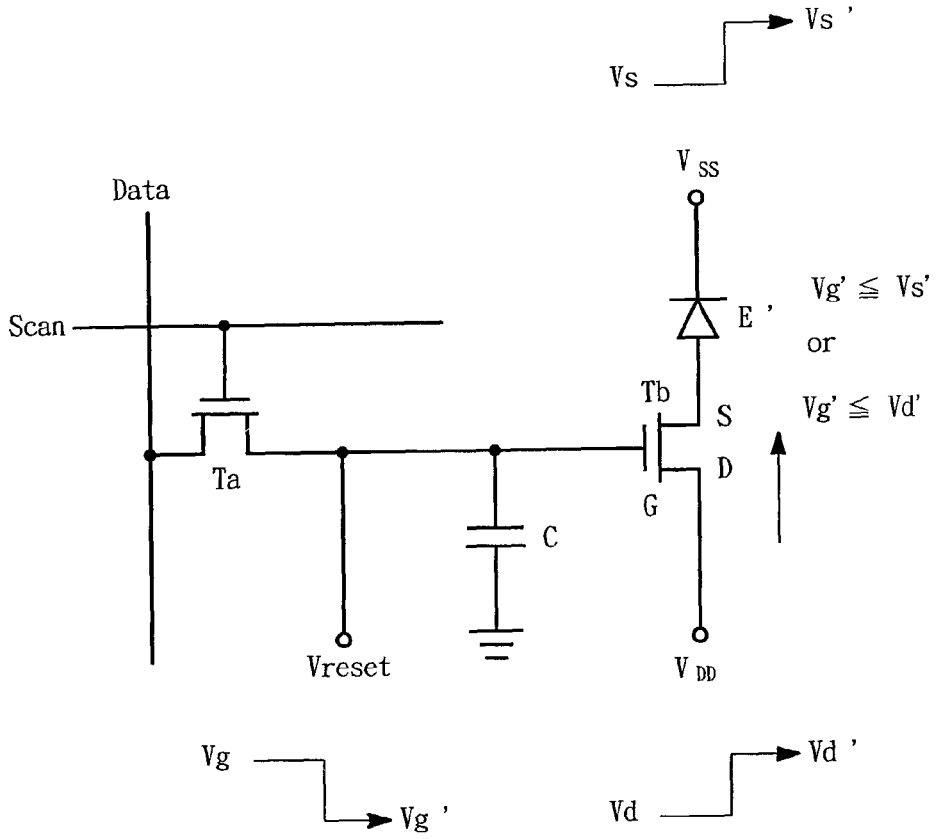
FIG. 3 is a second preferred embodiment of the method in accordance with the present invention.

FIG. 3 shows a second preferred embodiment in accordance with the present invention. The source electrode and the gate electrode of the switching transistor Ta are connected to a data line Data and a scan line Scan, respectively. The drain electrode D and the source electrode S of the driving transistor Tb are electrically connected to a displaying voltage source and a luminescent element E', such as non-inverted OLED. The gate electrode G of the driving transistor Tb is electrically connected to the drain electrode of the switching transistor Ta, the capacitor C, and a resetting voltage source. An electrode of the luminescent element E' is connected to the source electrode S of the driving transistor Tb, and another electrode is connected to a secondary voltage source Vss.

Figure 4:
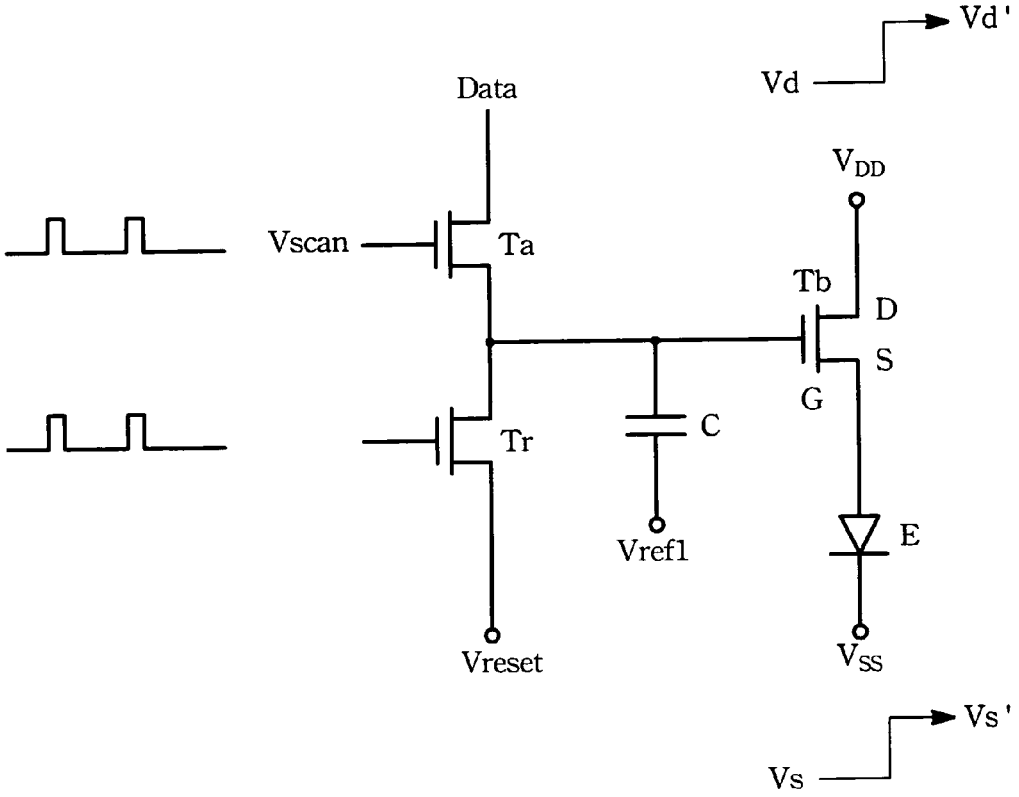
FIG. 4 is a third preferred embodiment of the method in accordance with the present invention.

FIG. 4 shows a third preferred embodiment in accordance with the present invention. In addition to the switching transistor Ta, the driving transistor Tb, the luminescent element E, and the capacitor C provided in FIG. 2A, an end of the capacitor is connected to a reference voltage Vref1, each pixel has a TFT Tr utilized as a switch for the resetting voltage source Vreset. The source electrode of the TFT Tr is connected to the resetting voltage source Vreset to provide a reference voltage. The drain electrode of the TFT Tr is connected to the drain electrode of the switching transistor Ta, the capacitor C, and the gate electrode of the driving transistor Tb. It is noted that the source electrodes of all the TFTs Tr within the pixel array are connected to a common resetting voltage source Vreset. When resetting, the switching transistor Ta is turned off and the TFT Tr is turned on to provide gate resetting voltage Vg' to the driving transistor Tb.

As to the three embodiments mentioned above, the luminescent element connected to the source electrode or the drain electrode of the transistor only shows different influence to the steady of adjusting voltages provided by the displaying voltage source $V_{DD}$ and the secondary voltage source Vss. In contrast, the polarity of the adjusting voltage as well as the timing of providing the adjusting voltage remains the same.

The step in the present invention of providing the source resetting voltage and the drain resetting voltage may be performed before, after, or simultaneous to the step of providing the gate resetting voltage. In addition, the switching transistor should be turned off when resetting to prevent the illumination of the OLED from influencing the normal operation of the OLED.

While the embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

What is claimed is:

1. A method for resetting electricity of a driving thin film transistor (driving TFT), comprising the steps of:

providing an electric circuit of a pixel, wherein the pixel includes:

a scan line, a data line, a switching thin film transistor (switching TFT), wherein a gate electrode and a source electrode of the switching TFT are connected to the scan line and the data line respectively, to be switched on by a scan signal of the scan line for transferring a data signal of the data line, and a driving TFT, wherein a gate electrode of the driving TFT is connected to a drain electrode of the switching TFT, to be switched on by the data signal from the switching TFT, for transferring a driving voltage to drive a light—emitting diode to light, providing a gate voltage to the gate electrode of the driving TFT;

providing a source voltage to a source electrode of the driving TFT;

providing a drain voltage to a drain electrode of the driving TFT; and performing a resetting step to lower the gate voltage and increase at least one of the source voltage and the drain voltage, wherein the gate voltage is smaller than the source voltage to form an electric field between the gate electrode and the source electrode to release the electrons trapped in a gate dielectric layer back to a channel of the driving TFT for preventing the shift of threshold voltage, wherein the step of lowering the gate voltage and the step of increasing the drain voltage are performed simultaneously.

2. The method of claim 1, wherein a potential difference between the gate voltage and the source voltage ranges from about 10 to about 100 volt.

3. The method of claim 1, wherein a potential difference between the gate voltage and the drain voltage ranges from about 30 to about 100 volt.

4. The method of claim 1, wherein the gate voltage is smaller than or equal to about 0 volt.

5. The method of claim 1, wherein the gate voltage is smaller than or equal to about −10 volt.

6. The method of claim 1, wherein the source voltage is greater than or equal to about 10 volt.

7. The method of claim 1, wherein the drain voltage is greater than or equal to about 10 Volt.

8. The method of claim 1, wherein the step of lowering the gate voltage and the step of increasing the source voltage are performed simultaneously.

9. A method for resetting electricity of a driving thin film transistor (driving TFT), comprising the steps of:

providing an electric circuit of a pixel, wherein the pixel includes a scan line, a data line, a switching thin film transistor (switching TFT), wherein a gate electrode and a source electrode of the switching TFT are connected to the scan line and the data line respectively, to be switched on by a scan signal of the scan line for transferring a data signal of the data line, and a driving TFT, wherein a gate electrode of the driving TFT is connected to a drain electrode of the switching TFT, to be switched on by the data signal from the switching TFT, for transferring a driving voltage to drive a light-emitting diode to light;

performing a resetting step, comprising:

lowering a gate voltage provided to said gate electrode to a gate resetting voltage, wherein said gate resetting voltage is at least 15 volts more negative than said data signal;

increasing a source voltage provided to said source electrode to greater than thirty volts;

increasing a drain voltage provided to said drain electrode to greater than thirty volts wherein the step of lowering the gate voltage and the step of increasing the source voltage are performed simultaneously.

10. A method for resetting electricity of a driving thin film transistor (driving TFT), comprising the steps of:

providing an electric circuit of a pixel, wherein the pixel includes:

a scan line, a data line, a switching thin film transistor (switching TFT), wherein a gate electrode and a source electrode of the switching TFT are connected to the scan line and the data line respectively, to be switched on by a scan signal of the scan line for transferring a data signal of the data line, and a driving TFT, wherein a gate electrode of the driving TFT is connected to a drain electrode of the switching TFT, to be switched on by the data signal from the switching TFT, for transferring a driving voltage to drive a light—emitting diode to light, providing a gate voltage to the gate electrode of the driving TFT;

providing a source voltage to a source electrode of the driving TFT;

providing a drain voltage to a drain electrode of the driving TFT; and performing a resetting step to lower the gate voltage and increase at least one of the source voltage and the drain voltage, wherein the gate voltage is smaller than the source voltage to form an electric field between the gate electrode and the source electrode to release the electrons trapped in a gate dielectric layer back to a channel of the driving TFT for preventing the shift of threshold voltage, wherein the step of lowering the gate voltage and the step of increasing the source voltage are performed simultaneously.

11. The method of claim 10, wherein a potential difference between the gate voltage and the source voltage ranges from about 10 to about 100 volt.

12. The method of claim 10, wherein a potential difference between the gate voltage and the drain voltage ranges from about 30 to about 100 volt.

13. The method of claim 10, wherein the gate voltage is smaller than or equal to about 0 volt.

14. The method of claim 10, wherein the gate voltage is smaller than or equal to about −10 volt.

15. The method of claim 10, wherein the source voltage is greater than or equal to about 10 volt.

16. The method of claim 10, wherein the drain voltage is greater than or equal to about 10 Volt.

* * * * *